US006421222B1

(12) United States Patent
Maritz et al.

(10) Patent No.: US 6,421,222 B1
(45) **Date of Patent: *Jul. 16, 2002**

(54) PRECISION FAIL-SAFE ELECTROSTATIC DISSIPATING DEVICE

(75) Inventors: James A. Maritz, St. Louis; Emil F. Madorin, Ferguson, both of MO (US)

(73) Assignee: Warson Group, Inc., St. Louis, MO (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/481,034

(22) Filed: Jan. 11, 2000

(51) Int. Cl.[7] ..... H05F 3/00
(52) U.S. Cl. ..... 361/224; 361/223
(58) Field of Search ..... 361/224, 223

(56) References Cited

U.S. PATENT DOCUMENTS

| | | | | |
|---|---|---|---|---|
| 2,710,366 | A | 6/1955 | Stern, Jr. et al. | 361/224 |
| 2,712,099 | A | 6/1955 | Legge | 317/2 |
| 2,857,556 | A | 10/1958 | Price | 361/224 |
| 3,196,314 | A | 7/1965 | Meltzer | 361/224 |
| 3,287,602 | A | 11/1966 | Meltzer | 361/224 |
| 3,293,494 | A | 12/1966 | Fischer | 361/224 |
| 3,898,538 | A | 8/1975 | Dalton | 317/2 B |
| 4,366,630 | A | 1/1983 | Bloom | 36/30 |
| 4,727,452 | A | 2/1988 | Brownlee | 361/224 |
| 4,785,371 | A | 11/1988 | Edwards | 361/224 |
| 5,233,769 | A | 8/1993 | Weber | 36/44 |
| 5,319,867 | A | 6/1994 | Weber | 36/44 |
| 5,653,047 | A | 8/1997 | Franey | 361/136 |

*Primary Examiner*—Stephen W. Jackson
(74) *Attorney, Agent, or Firm*—Peter S. Gilster; Kelly K. Burris; Greensfelder, Hemker & Gale, P.C.

(57) ABSTRACT

The present invention involves an apparatus for dissipating electrostatic charges while providing protection against undesirable high amperage current, and takes the form of ESD (Electrostatic Dissipating) footwear, which protects against the accumulation of electrostatic charges by dissipating the charges through controlled ohmic path leakage between the user and a ground. The apparatus is primarily constructed of several conductive layers and a set of parallel resistors, whereby the conductive layers are adapted to integrate with existing construction techniques of a multitude of footwear styles, in addition to a wide variety of electrical devices. The parallel resistors provide fail-safe operation and accurate, repeatable resistance for the apparatus. The apparatus can be attached to or embedded within a multitude of footwear styles or other devices to provide electrostatic dissipation between the user or electrical device and a ground.

27 Claims, 7 Drawing Sheets

PRECISION FAIL-SAFE ELECTROSTATIC DISSIPATING DEVICE

BACKGROUND OF THE INVENTION

1. Field of the Invention

The present invention relates to the field of electrostatic discharging whereby electrical charges resulting from static electricity are dissipated from a charged source to an electrical ground through a resistance-controlled path. The electrical charges are dissipated in order to prevent the accidental discharge of electricity between the charged source and another object that the charged source may come in contact with. Furthermore, the resistance-controlled path protects the user or device from the passage of an externally applied high amperage current.

2. Known Art

Methods and devices for electrostatic dissipation are numerous and well known in the art, and are often referred to as ESD, or electrostatic dissipating, devices. Electrostatic dissipating is desirable in numerous applications including but not limited to footwear used while fabricating/assembling electronic circuitry, equipment used while refueling vehicles, and other uses where an accidental discharge of static electricity between the user and a device would be undesirable.

Industry standards for the dissipation of electrostatic charges are often used in the design and manufacture of known ESD devices. A known standard used to determine whether an ESD device provides safe levels of electrostatic dissipation is ANSI (American National Standards Institute) Z41, Section 6, titled "Static Dissipative Footwear". ANSI Z41 is currently undergoing revision to address the amount of variation or inconsistency in repeated resistance values of ESD footwear.

One category of known ESD devices use a grounding strap, whereby the grounding strap is physically connected from the electrostatically charged source, such as a human user or an electrical device, to an electrical ground. There exist body grounding heel straps (Van Atta et al U.S. Pat. No. 2,586,747), leg straps (Legge U.S. Pat. Nos. 2,712,098 and 2,933,651), and wrist straps (Burke U.S. Pat. No. 3,596,134) to dissipate static electricity between a human user or an electrical device and an electrical ground. The physical straps, however, are cumbersome to attach and to wear during the course of activities and severely limit the physical range of motion of the user or device requiring grounding. The use of such straps can often become such an annoyance that their use is intentionally avoided by the user, thereby resulting in increased susceptibility of electrical components to damage, and more importantly, a sacrifice in user safety. In addition, the straps are in some cases disposable, thus resulting in significant costs to a company with a considerable number of employees using and disposing the straps on a daily basis.

Another category of known ESD devices incorporate the necessary electrical elements into an otherwise single-function device such as a shoe. The use of conductive materials with a controlled ohmic path within the construction of a shoe have been provided in Edwards U.S. Pat. No. 4,785,371, and in Legge U.S. Pat. No. 2,712,099. While the known ESD footwear has the advantage of providing a self-contained capability for providing the requisite electrically resistive path for safely grounding the wearer, generally within a range of $10^6$ to $10^8$ ohms, the level of resistance between the wearer and the ground is unacceptably variable within this range. The level of resistance is variable in the known art because ESD properties exist in various layers throughout the shoe, (outsole, midsole, and insole), which all contribute to the resulting resistance level for the entire shoe. Edwards employs a controlled ohmic path via multiple conductive and resistive layers throughout the construction of footwear. The incorporation of the resistance throughout many layers, however, results in a wide variation in the level of total resistance provided by the shoe. Furthermore, Edwards does not provide a fail-safe mechanism within its construction in the event of a high amperage current attempting to pass through the circuit.

A critical limitation of the known art is the inability to achieve a precise and fail-safe level of resistance between the electrically charged source and the electrical ground. Precise resistance is an advantage in industrial applications where static control is critical, such as users of computer chips. Furthermore, fail-safe operation is required such that an externally applied high amperage current can be passed through the device, and more specifically through the resistance device, without resulting in harmful or even fatal results to the user and any surrounding occupants or observers.

The known ESD footwear, such as those shown in the above-mentioned Edwards and Legge patents, are incapable of providing a precise resistance level on a repeatable basis for a single ESD device in combination with a fail-safe functionality. Furthermore, there has not yet been achieved a truly reliable, fail-safe construction in which change or opening of any resistors or electrically resistive elements of the shoes will result in an acceptable degradation in overall resistance between the wearer and ground. Although multiple resistors have been proposed, as in Legge, the construction of footwear described in that patent is rendered needlessly complex because of the need to insert discrete resistors at various locations within a shoe so equipped, thus causing manufacture to be both complex and costly. Moreover, the Legge construction is not amenable to each of many styles of footwear, as to which is desired to be able to manufacture the various styles with predetermined total resistance in both normal use and fail-safe condition of use. The Legge construction incorporates "safety fuses" as individual parts in discrete locations of the entire ESD shoe assembly. The "safety fuses", therefore, are not incorporated into a single unit that can easily be installed.

SUMMARY OF THE INVENTION

Accordingly, among the several objects, features and advantages of the invention may be noted the provision of improved devices for the dissipation of static electricity; which include a unique combination of conductive layers providing a continuous electrical path between the user or device and a ground; which dissipates static electricity through a controlled ohmic path; which repeatably and reliably delivers a precise resistance level by using at least one set of parallel resistors, whereby failure of one resistor results in a precise change in resistance level which in turn results in continued safe operation of the ESD device; which construction is adaptable to utilize standard components of a wide variety of electrical devices; which construction utilizes the standard components used in the manufacture of a wide variety of footwear styles; which construction provides a safe level of physical protection for the conductive layers and the parallel resistors; which construction utilizes only a single unit of parallel resistors within the multiple conductive layers to control the ESD properties of the entire device; which utilizes distinctive principles for both construction and operation thereby providing an ESD device capable of being adapted to a wide variety of applications.

The precise and fail-safe ESD properties are provided by a set of parallel resistors that are sandwiched between layers of conductive materials throughout the device. For example, two 3 megohm resistors connected in parallel will produce a total resistance for the device of 1.5 megohms. The new ESD footwear is intended to take advantage of a principle known in the electronics art, but not known in the art of ESD footwear, that the combined conductance of a number of parallel-connected resistors is the sum of their separate conductances:

$$\frac{1}{R} = \frac{1}{R_1} + \frac{1}{R_2} + \frac{1}{R_3} + \cdots$$

whereby the equivalent resistance for two parallel resistors having resistances $R_1$, $R_2$ is:

$$R = \frac{R_1 R_2}{(R_1 + R_2)}; \text{ and if } R1 = R2, \therefore R = R/2$$

Therefore, with two resistors each having a resistance of 3 megohms, the total resistance for the circuit would be one half of the resistance value of the common resistance value, or 1.5 megohms. Furthermore, if one resistor should fail, the resistance of the circuit becomes 3 megohms, well within safe operating limits for typical ESD applications, thereby providing continued safe operation of the ESD device. Depending on the level of resistance required for the ESD application, the value of each parallel resistor can be adjusted accordingly.

The construction of the conductive layers and the parallel resistors within the layers is such that the apparatus repeatably delivers a precise resistance value. As will become apparent in the forthcoming detailed description, the distinct and unique construction employed to achieve accurate and fail-safe resistance can be incorporated into a multitude of ESD applications.

Briefly, an electrostatic dissipating device of the present invention, as in the form of new ESD footwear, provides both controlled dissipation of electrostatic charges and fail-safe operation through a unique construction of conductive layers and at least one set of parallel resistors. The conductive layers are achieved through the use of a conductive thread sewn to interior footwear layers wherein wire leads of the set of parallel resistors contact the conductive thread on one side, and subsequently contact conductive members of an outer sole on the other side, thereby comprising the distinctive conductive and resistive layering that subsequently grounds the user or device to the ground.

Other objects and features will be apparent or are pointed out more particular herein below.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
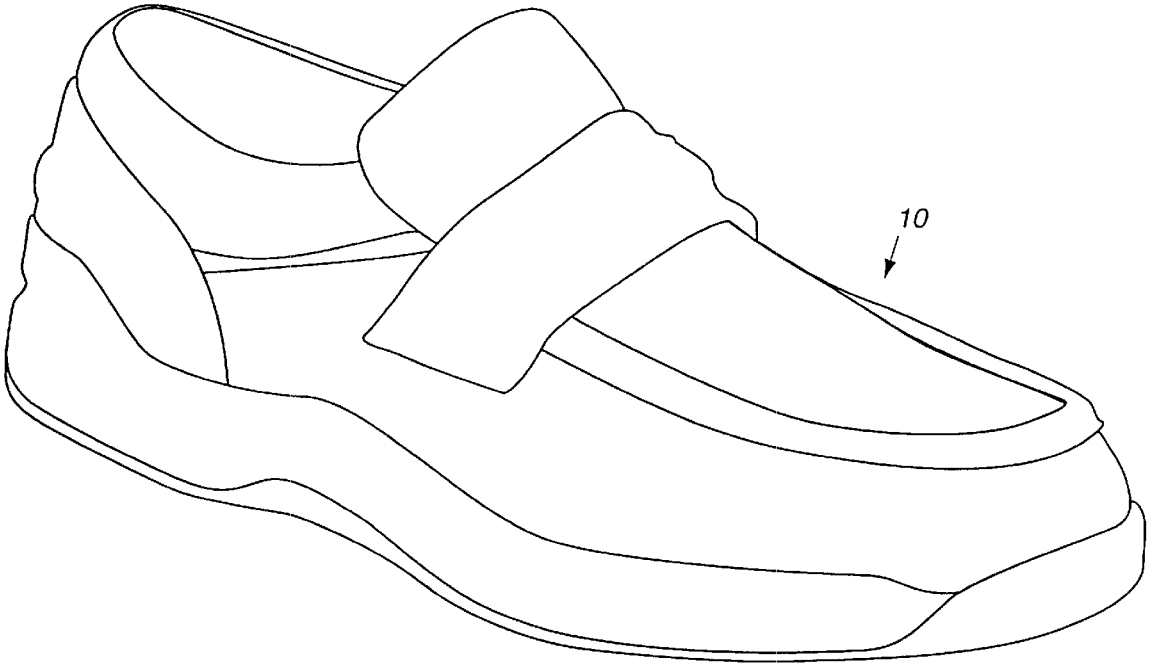
FIG. 1 is a perspective view of an example style of electrostatic dissipating footwear in accordance with and embodying the present invention.

Corresponding reference characters indicate corresponding parts throughout the several views. Although the drawings represent embodiments of the present invention, the drawings are not necessarily to scale and certain features may be exaggerated in order to better illustrate and explain the present invention.

DESCRIPTION OF PRACTICAL EMBODIMENT

Referring to the drawings, as illustrated in FIG. 1, the apparatus of the present invention can be used in conjunction with electrostatic dissipating (ESD) footwear 10 for the dissipation of static electricity during operations involving sensitive electronic circuitry. The present description for the ESD footwear application is merely representative of using the invention in many possible footwear styles for application of the present invention. The footwear enablement of the present invention is not exclusive of other applications which require ESD capability. The distinct and unique characteristics of the present invention can be utilized in combination for a multitude of applications requiring precise and fail-safe dissipation of static electricity.

As shown further in FIGS. 2*a–d,* the present invention comprises several internal and external footwear layers including upper 12, sock liner 14, insole 16, resistor pack 18, midsole cushion 20, and outer sole 22. Outer sole 22 is generally secured to midsole cushion 20 by known techniques such as adhesive bonding. Resistor pack 18 and insole 16 are similarly secured to midsole cushion 20 using known techniques such as adhesive bonding. Sock liner 14 is removably engaged with insole 16 and upper 12 such that replacement is facilitated upon excessive wear of sock liner 14. Furthermore, upper 12 is secured to midsole cushion 20 and outer sole 22 by known techniques such as adhesive bonding. Although a casual shoe without laces is shown, the footwear may be of any number of other styles, either including or not including laces, such as tennis shoes, loafers, low- and high-heeled shoes, boots, sandals, and so forth. Furthermore, the ESD footwear construction as described herein can be adapted to a variety of internal and external footwear layers.

Figure 2A:
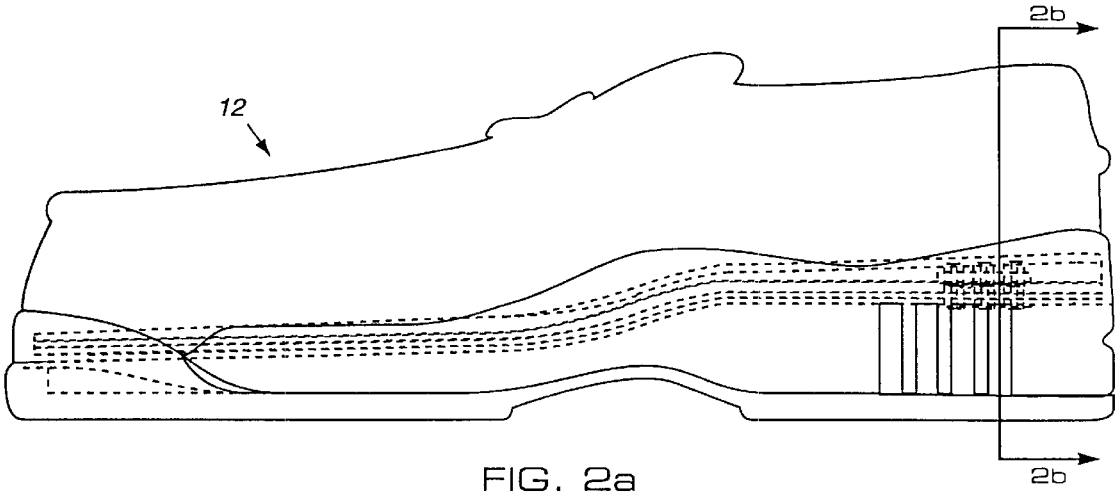
FIG. 2*a* is a side view of the electrostatic dissipating shoe showing a construction in accordance with a known embodiment of the present invention.
Figure 2C:
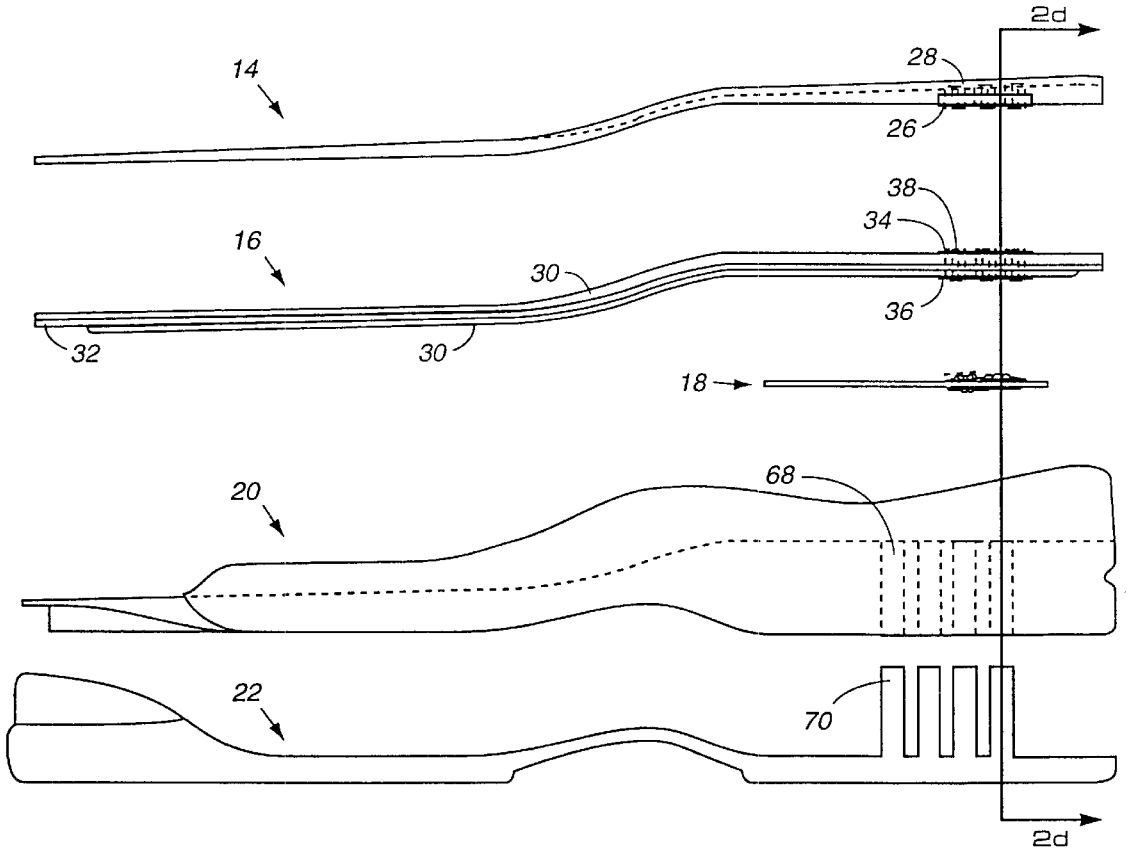
FIG. 2*c* is an exploded side view of the electrostatic dissipating shoe illustrating each of the layers in accordance with a known embodiment.
Figure 2B:
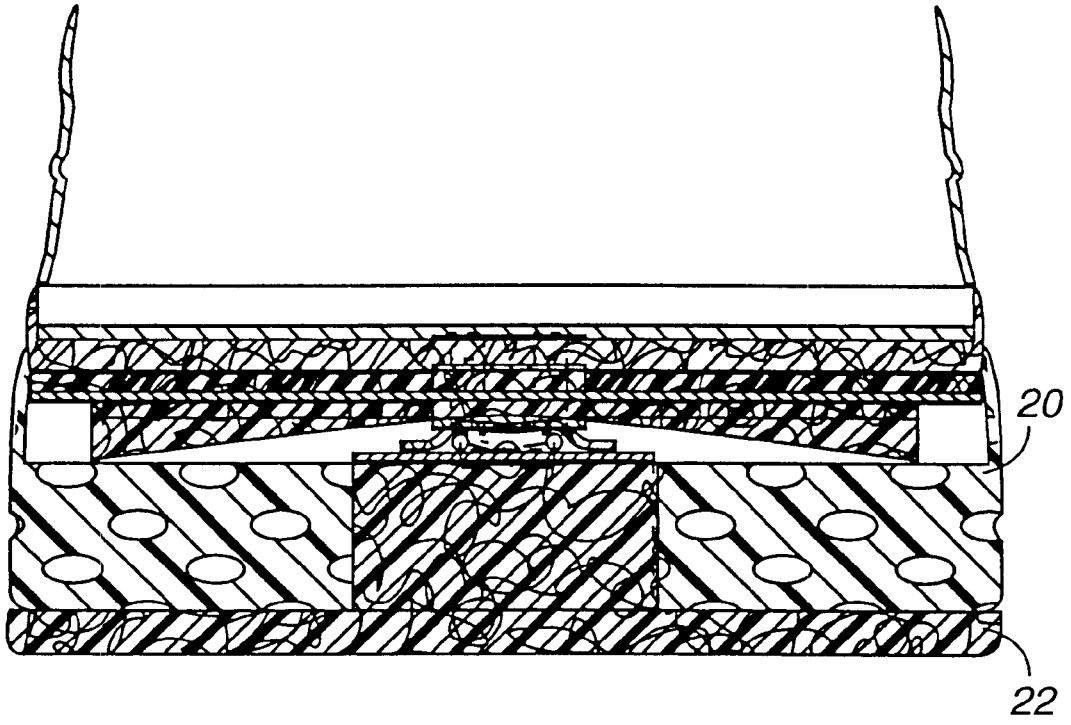
FIG. 2*b* is a rear sectional view of the electrostatic dissipating shoe taken along section 2*b* of FIG. 2*a*.
Figure 4A:
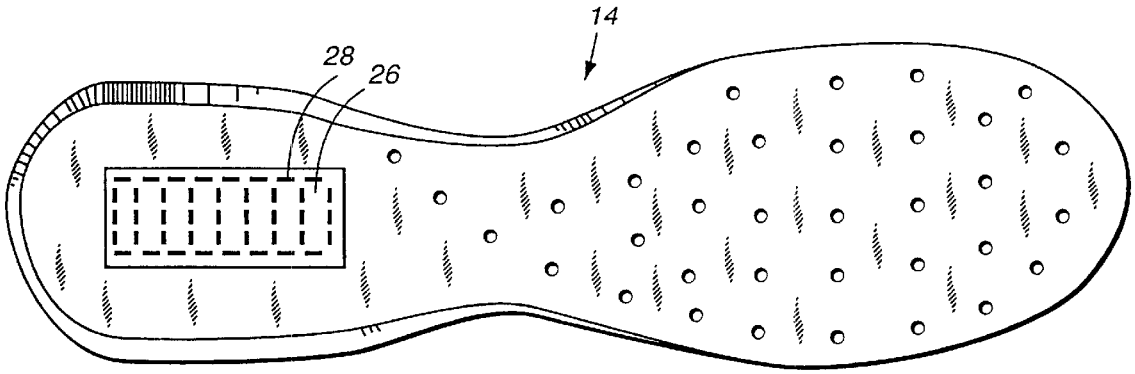
FIG. 4*a* is a top view of the sock liner.
Figure 4B:
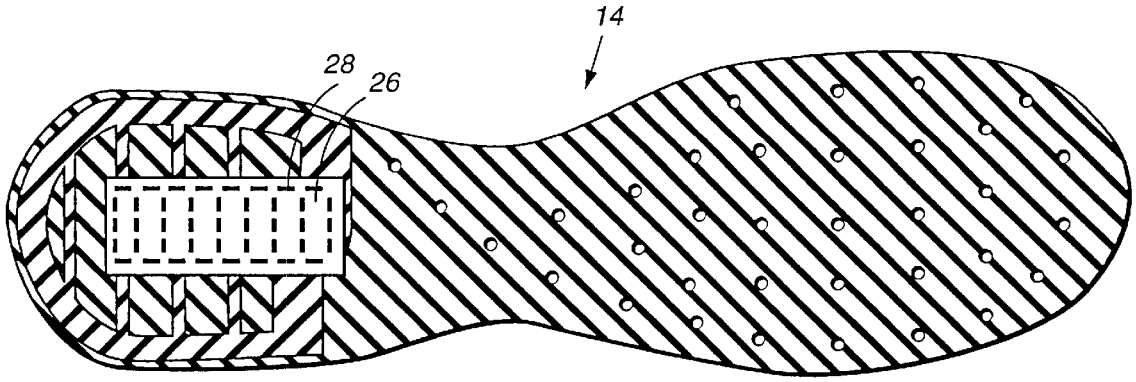
FIG. 4*b* is a bottom view of the sock liner.

Referring to FIGS. 2*c* and 4*a–b,* sock liner 14 includes product tag 26 and conductive thread 28. Product tag 26 is secured to sock liner 14 with conductive thread 28. As best shown in FIGS. 4*a–b,* product tag 26 covers an upper and a lower surface area of sock liner 14, wherein product tag 26 is sewn to sock liner 14 with conductive thread 28 such that conductive thread 28 is relatively stable and secure to facilitate unrestricted physical contact with subsequent conductive layers. Product tag 26, therefore, provides the necessary contact area for conductive thread 28 to conductively engage successive layers within the construction of ESD footwear 10. Conductive thread 28 is preferably comprised of a known nylon material thread having conductive carbon thread intertwined therein. Sock liner 14 and product tag 26 are typical of many footwear styles, where sock liner 14 provides a comfortable cushion and product tag 26 identifies the manufacturer or company selling the particular footwear brand. Conductive thread 28 is generally adaptable to a multitude of sock lining construction types of general footwear, and is not limited to sock liner 14 and product tag 26 configuration discussed herein.

Figure 5A:
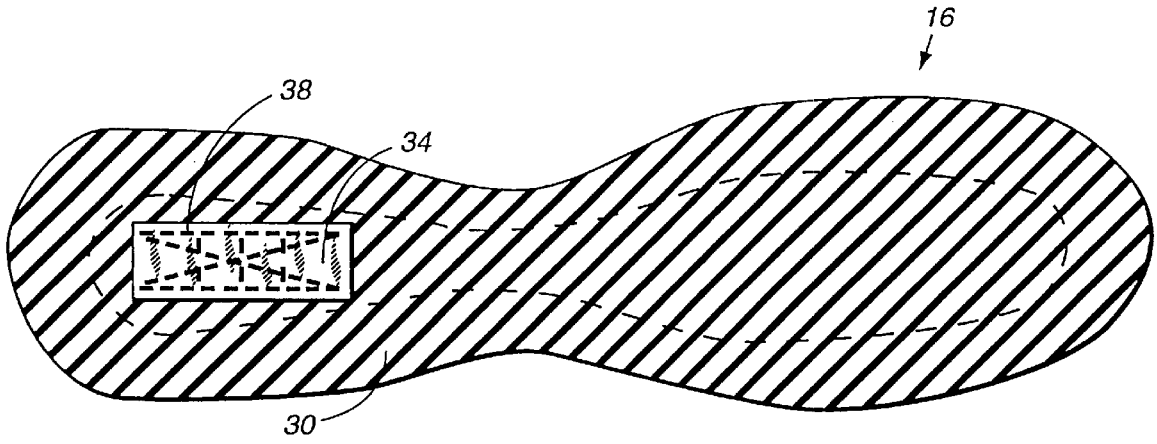
FIG. 5*a* is a top view of the insole assembly.
Figure 5B:
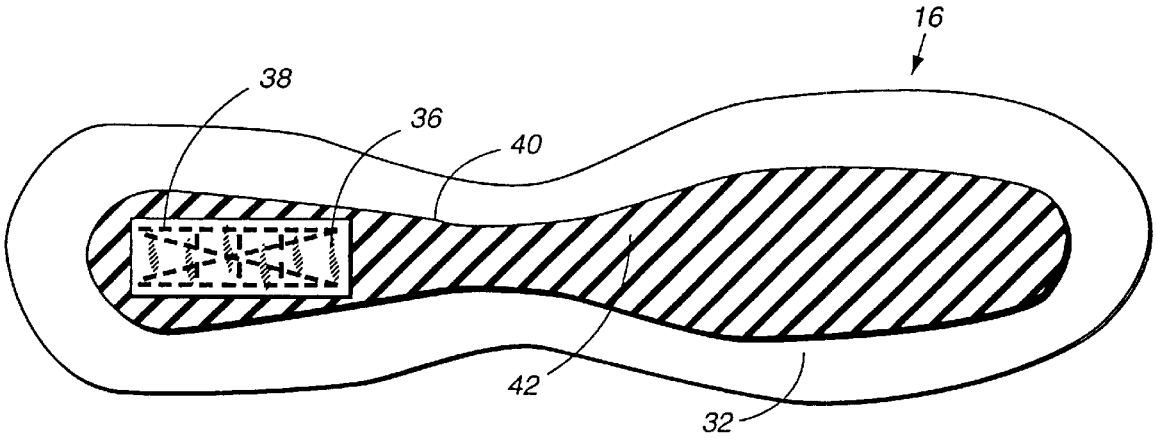
FIG. 5*b* is a bottom view of the insole assembly.

As shown in FIGS. 2*c* and 5*a–b,* insole 16 is comprised of insole cushion 30, insole board 32, upper thread carrier 34, lower thread carrier 36, and conductive thread 38. The construction of insole 16 discussed herein is not intended to be exclusive of general insole construction for all footwear styles. It will be understood that the conductive construction described herein can be adapted to a multitude of insoles of footwear styles.

As best shown in FIGS. 5*a–b,* insole board 32 includes interior periphery 40 through which raised protrusion 42 of insole cushion 30 is disposed. Insole cushion 30 provides the desired level of comfort and insole board 32 provides the necessary stability and support for ESD shoe 10. Upper thread carrier 34 and lower thread carrier 36 are fixably attached to insole cushion 30 with conductive thread 38. The area of insole cushion 30 covered by upper thread carrier 34 and lower thread carrier 36 provides the necessary contact area for conductive thread 38 to conductively engage successive layers within ESD footwear 10 construction. Upper thread carrier 34 and lower thread carrier 36 also provide a more stable and secure area for conductive thread 38 to contact neighboring conductive layers than that which would be provided if conductive thread 38 were sewn only to an area of insole cushion 30.

Insole cushion 30 is typical of many types of footwear construction and is generally a pliable polyurethane material used for cushioning effect. Insole board 32 is also typical of many types of footwear construction and is generally a cellulose fiber board that is flexible and resistant to cracks. Insole cushion 30 is fixably attached to insole board 32 preferably by known methods such as adhesive bonding. Upper thread carrier 34 and lower thread carrier 36 are preferably a higher density textile material such as a cotton-polyester blend which can provide the necessary local stability for conductive thread 38. As with conductive thread 28 of sock liner 14, conductive thread 38 of insole 16 is also preferably comprised of a known nylon material thread having conductive carbon thread intertwined therein. Upper thread carrier 34, lower thread carrier 36, and conductive thread 38 are generally adaptable to a multitude of insole construction types and are not limited to the insole cushion 30 and insole board 32 configuration discussed herein.

Figure 3A:
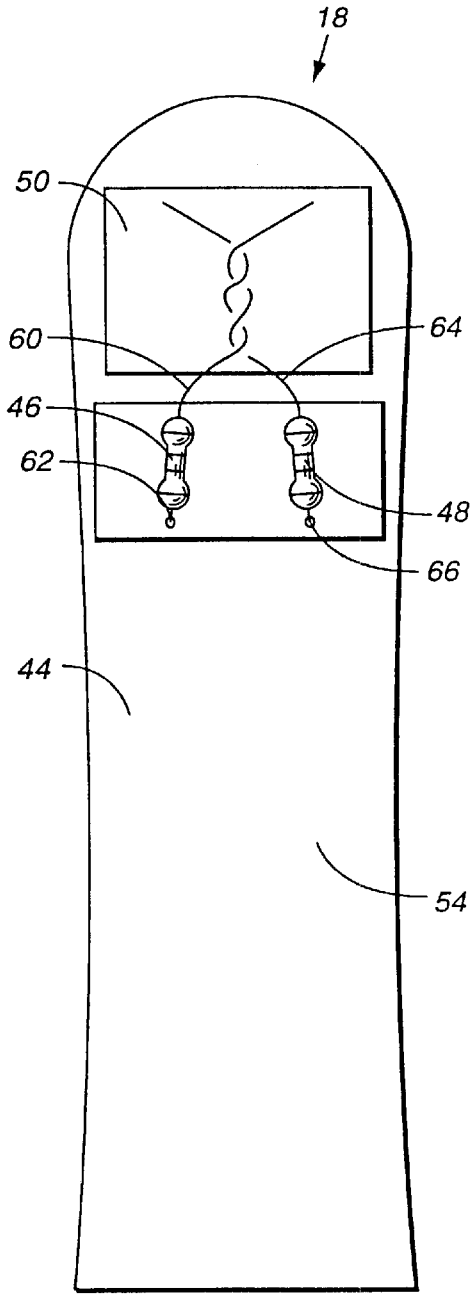
FIG. 3*a* is an enlarged top view of the resistor module.
Figure 3B:
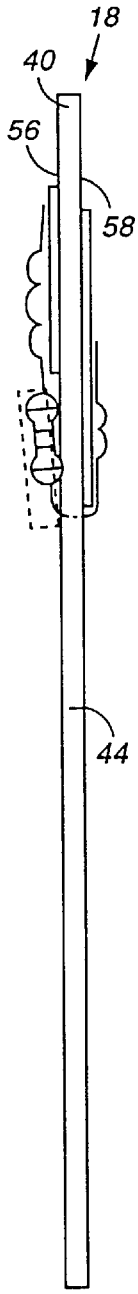
FIG. 3*b* is an enlarged side view of the resistor module.
Figure 3C:
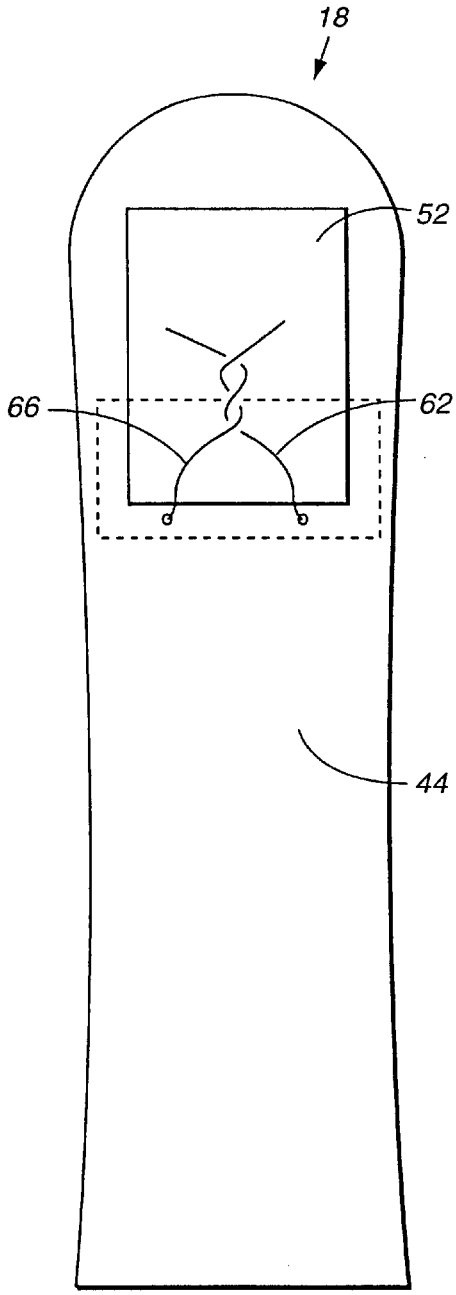
FIG. 3*c* is an enlarged bottom view of the resistor module.

As best shown in FIGS. 3*a–c,* resistor pack 18 includes insulator 44, first parallel resistor 46, second parallel resistor 48, upper protective cloth 50, lower protective cloth 52, and resistor shield 54. Insulator 44 includes upper surface 56 and lower surface 58. First parallel resistor 46 includes first wire lead 60 and second wire lead 62. Second parallel resistor 48 also includes first wire lead 64 and second wire lead 66. First parallel resistor 46 and second parallel resistor 48 are removably disposed on insulator upper surface 56, wherein first parallel resistor second wire lead 62 and second parallel resistor second wire lead 66 traverse and pierce through insulator upper surface 56 and insulator lower surface 58 as best shown in FIGS. 3*a* and 3*c*. First parallel resistor second wire lead 62 and second parallel resistor second wire lead 66 are intertwined near insulator lower surface 58 as shown in FIG. 3*c*. First parallel resistor first wire lead 60 and second parallel resistor first wire lead 64 traverse insulator upper surface 56 and are intertwined as shown in FIG. 3*a*. Upper protective cloth 50 is fixably attached to insulator upper surface 56 and is therefore disposed between first and second parallel resistor first wire leads 60, 64 and insulator 44. Upper protective cloth 50 thereby prevents first parallel resistor first wire lead 60 and second parallel resistor first wire lead 64 from contacting insulator 44 such that there is no means for accidental electrical discharge through insulator 44. Similarly, lower protective cloth 52 is fixably attached to insulator lower surface 58 and is therefore located between first and second parallel resistor second wire leads 62, 66 and insulator 44. Resistor shield 54 is placed over the top of first and second parallel resistors 46, 48 to protect against inadvertent damage from harsh physical impacts. Both first and second parallel resistors 46, 48 have a resistance of 3 megohms each in one known embodiment of the present invention. The total resistance, therefore, for ESD footwear 10 is 1.5 megohms. Insulator 44 is preferably made of ethyl vinyl acetate (EVA) to protect and stabilize first and second parallel resistors 46, 48. The EVA material prevents accidental discharge of electricity between the surrounding conductive layers and also provides cushioning to prevent accidental breakage of first and second parallel resistor first and second wire leads 60, 62, 64, 66.

Figure 2D:
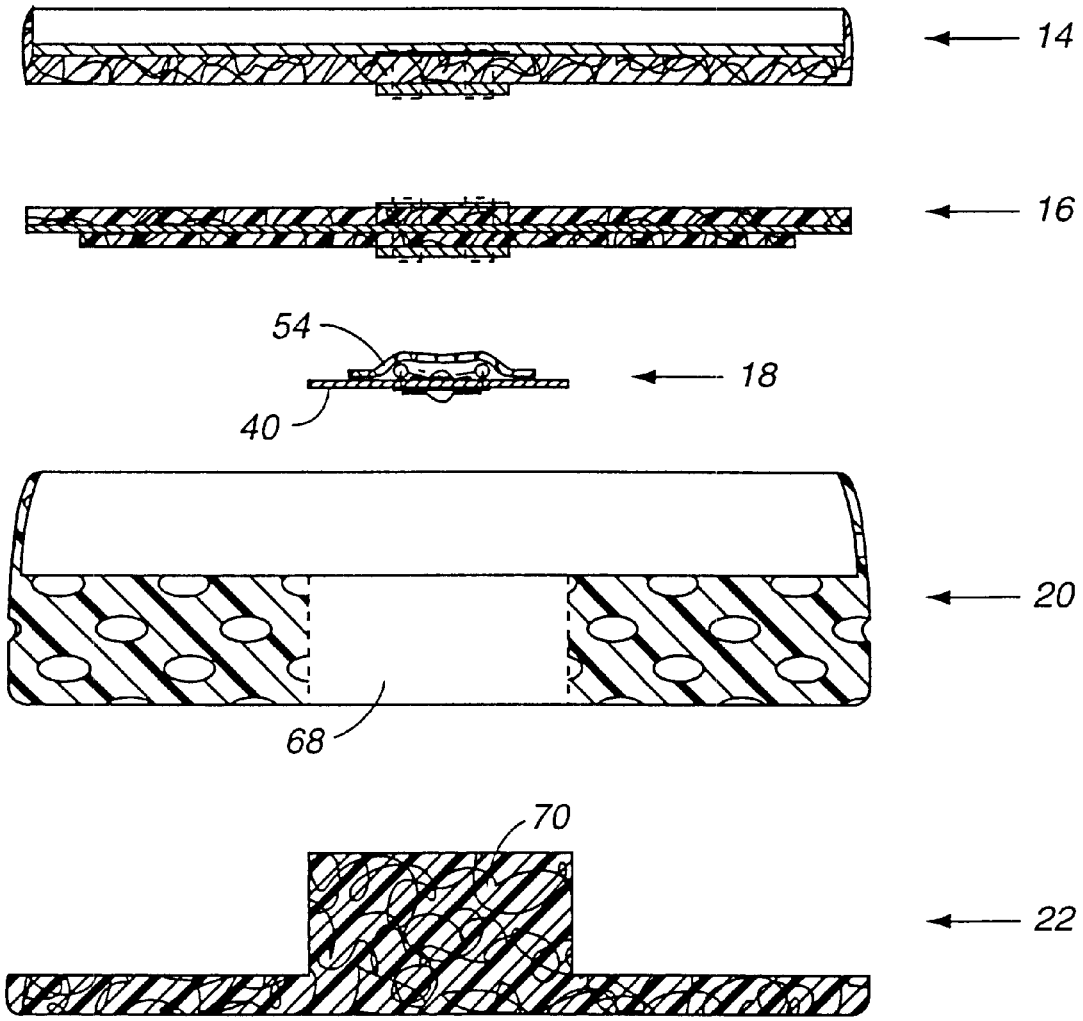
FIG. 2*d* is an exploded rear sectional view of the electrostatic dissipating shoe taken along section 2*d*.

As shown in FIGS. 2*c–d,* ESD footwear 10 further includes midsole cushion 20 and outer sole 22. Midsole cushion 20 includes slots 68, and outer sole 22 includes conductive risers 70, whereby conductive risers 70 are insertably engaged with midsole cushion slots 68. Upon insertion into midsole cushion slots 68, conductive risers 70 are positioned for contact with first and second parallel resistor second wire leads 62, 66 of resistor pack 18. Conductive risers 70 and midsole cushion slots 68 can be either singular or present in a plurality to provide the required physical contact for conductive engagement. Midsole cushion 20 is generally made of a known rubber, ethyl vinyl acetate, polyurethane or other known material, and outer sole 22 is generally made of a known conductive rubber.

The complete electrical circuit for dissipating static electricity and providing fail-safe operation in the event of a high amperage current therefore consists of: the foot of a user in physical contact with conductive thread 28 of sock liner 14; conductive thread 28 of sock liner 14 being in physical contact with conductive thread 38 of insole 16; conductive thread 38 of insole 16 being in physical contact with first and second resistor first wire leads 60, 64; first and second resistor second wire leads 62, 66 being in physical contact with conductive risers 70; and outer sole 22 being in physical contact with the ground. Alternatively, the complete electrical circuit would comprise the resistor pack disclosed herein in conductive contact between an electrical device and the ground.

Furthermore, in the event of a complete failure of resistor pack 18 wherein each of parallel resistors 46 and 48 are open, ESD shoe 10 continues to maintain a low level of resistance thereby providing some level of protection to the wearer. The residual resistance of ESD shoe 10 in the event of resistor pack 18 failure is provided by the combination of materials in outer sole 22, midsole cushion 20, and sock liner 14. The distinct and unique construction of ESD shoe 10, therefore, include safety protection features in addition to those provided by resistor pack 18.

In view of the foregoing description of the present invention and practical embodiments it will be seen that the several objects of the invention are achieved and other advantages are attained. The embodiments and examples were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting.

The breadth and scope of the present invention should not be limited by any of the above-described exemplary embodiments, but should be defined only in accordance with claims of the application and their equivalents.

What is claimed is:

1. Apparatus for dissipating electrostatic charges, said apparatus comprising:

electrically conductive layers; and at least one set of parallel resistors located within said electrically conductive layers, wherein said set of parallel resistors provides fail-safe operation and precise resistance for said apparatus, said set of parallel resistors having a set of first and second of wire leads, said parallel resistors being each connected to said first and second set of wire leads in parallel circuit relationship, one of said first and second set of wire leads forming a single continuous resistive grounding path whereby, if either resistor of said parallel resistors fails, electrical current may continue to flow in said grounding path for dissipating electrostatic charges.

2. The apparatus of claim 1 wherein said apparatus dissipates electrostatic charges from a human user to a grounding surface.

3. The apparatus of claim 1 wherein said apparatus dissipates electrostatic charges from an electrical device to a grounding surface.

4. The apparatus of claim 2 wherein said electrically conductive layers and said set of parallel resistors are located within the sole of footwear.

5. Apparatus for dissipating electrostatic charges, said apparatus comprising:

electrically conductive layers; and at least one set of parallel resistors located within said electrically conductive layers, wherein said set of parallel resistors provides fail-safe operation and precise resistance for said apparatus, said electrically conductive layers comprising:

at least one internal footwear layer having electrical conductivity;

a resistor pack comprising:

an insulator having an upper surface and a lower surface;

said set of parallel resistors being disposed on said upper surface of said insulator, said set of parallel resistors having a first and second set of wire leads;

wherein said first set of wire leads extend over at least a portion of said upper surface of said insulator, and said second set of wire leads extend through said upper surface and through said lower surface of said insulator to extend over at least a portion of said lower surface of said insulator; and at least one external footwear layer having electrical conductivity, said electrically conductive internal footwear layer being in physical contact with said first set of wire leads of said parallel resistors of said resistor pack, said second set of wire leads of said parallel resistors of said resistor pack being in physical contact with said electrically conductive external footwear layer, said electrically conductive external footwear layer being in contact with a grounding surface.

6. The apparatus of claim 5 wherein said resistor pack further comprises:

an upper protective cloth, a lower protective cloth, and a protective cover;

said upper protective cloth being located between said upper surface of said insulator and said first set of wire leads, and said lower protective cloth being located between said lower surface of said insulator and said second set of wire leads;

said protective cover being fixably disposed over said set of parallel resistors.

7. The apparatus of claim 5, said insulator being an ethyl vinyl acetate (EVA) material.

8. The apparatus of claim 5 wherein said internal footwear layer further comprises:

a sock liner having a thread carrier fixably attached to said sock liner with a conductive thread; and an insole having a thread carrier fixably attached to said insole with a conductive thread.

9. The apparatus of claim 8 wherein said insole further comprises:

an insole cushion; and an insole board;

said insole cushion fixably attached to said insole board.

10. The apparatus of claim 9 wherein said thread carrier of said insole is fixably attached to said insole cushion with said conductive thread of said insole, whereby said conductive thread of said insole is in physical contact with said set of parallel resistors first set of wire leads and said conductive thread of said insole is in physical contact with said sock liner.

11. The apparatus of claim 5 wherein said external footwear layer further comprises:

a midsole cushion; and a conductive rubber outer sole.

12. The apparatus of claim 11, said conductive rubber sole having a heel section, said heel section comprising at least one contact riser.

13. The apparatus of claim 11, said midsole cushion having at least one slot wherein said contact riser is insertably engaged with said slot, whereby said contact riser is in physical contact with said resistor pack.

14. The apparatus of claim 5, said parallel resistors each having an equivalent resistance value, thereby said set of parallel resistors producing a total resistance level of one half said equivalent resistance value.

15. The apparatus of claim 14, said equivalent resistance value being 3 megohms.

16. A method for dissipating static electricity through footwear using a resistance controlled path within an article of footwear, having at least one internal footwear layer and at least one external footwear layer, to a grounding surface, the improvement comprising the steps of:

(a) providing a resistor pack comprising:

an insulator having an upper surface and a lower surface;

a set of parallel resistors being disposed on said upper surface of said insulator, said set of parallel resistors having a first and second set of wire leads;

wherein said first set of wire leads extend over at least a portion of said upper surface of said insulator, and said second set of wire leads extend through said upper surface and through said lower surface of said insulator to extend over at least a portion of said lower surface of said insulator; and (b) placing the foot of a user in physical contact with said electrically conductive internal footwear layer, said electrically conductive internal footwear being placed in physical contact with said first set of wire leads of said parallel resistors of said resistor pack, said second set of wire leads of said parallel resistors of said resistor pack being placed in physical contact with said electrically conductive external footwear layer, said electrically conductive external footwear layer then being placed in contact with a grounding surface whereby static electrical charges are dissipated through the user into the grounding surface.

17. The method of claim 16, said resistor pack further comprising:

an upper protective cloth, a lower protective cloth, and a protective cover;

said upper protective cloth being located between said upper surface of said insulator and said first set of wire leads, and said lower protective cloth being located between said lower surface of said insulator and said second set of wire leads;

said protective cover being fixably disposed over said set of parallel resistors.

18. The method of claim 16, said insulator being an ethyl vinyl acetate (EVA) material.

19. The method of claim 16, said parallel resistors each having an equivalent resistance value, thereby said set of parallel resistors producing a total resistance level of one half said equivalent resistance value.

20. For use in an article of footwear providing static electricity dissipation for the wearer, wherein the footwear provides a path for static electricity to pass from the wearer to a grounding surface, the improvement comprising:

a resistor pack having at least one set of parallel resistors whereby said resistor pack is disposed within said path for static electricity to pass;

said parallel resistors being connected in parallel circuit relationship in said path whereby, if either resistor fails, electrical current may continue to flow in said path for conducting static electricity to said grounding surface through said path.

21. For use in an article of footwear providing static electricity dissipation for the wearer, wherein the footwear provides a path for static electricity to pass from the wearer to a grounding surface, said resistor pack further comprising:

an insulator having an upper surface and a lower surface;

a set of parallel resistors being disposed on said upper surface of said insulator, said set of parallel resistors having a first and second set of wire leads;

wherein said first set of wire leads extend over at least a portion of said upper surface of said insulator, and said second set of wire leads extend through said upper surface and through said lower surface of said insulator to extend over at least a portion of said lower surface of said insulator.

22. The apparatus of claim 21, said insulator being an ethyl vinyl acetate (EVA) material.

23. The apparatus of claim 21, said resistor pack further comprising:

an upper protective cloth, a lower protective cloth, and a protective cover;

said upper protective cloth being located between said upper surface of said insulator and said first set of wire leads, and said lower protective cloth being located between said lower surface of said insulator and said second set of wire leads;

said protective cover being fixably disposed over said set of parallel resistors.

24. Apparatus for dissipating electrostatic charges from an entity, said apparatus comprising:

a first electrically conductive layer contacted by said entity;

a second electrically conductive layer in contact with a grounding surface; and at least one set of parallel-connected resistors located between said electrically conductive layers, said parallel-connected resistors being interconnected in parallel circuit relationship said set of parallel-connected resistors together providing first and second sets of wire leads, said first and second electrode lead sets defining a single continuous resistive grounding path, which path includes said parallel-connected resistors, a first of said lead sets being electrically connected to the first electrically conductive layer, a second of said lead sets being electrically connected to the second electrically conductive layer, said single continuous resistive grounding path extending between the first and second electrically conductive layers to discharge electrostatic charges from the entity to the grounding surface through the single continuous resistive grounding path with precise resistance defined by the parallel-connected resistors but providing fail-safe operation wherein, if one of said parallel-connected resistors fails, whereby electrostatic charges may be discharged from the entity to the grounding surface through said single continuous resistive grounding path for safely dissipating electrostatic charges even if one of said parallel-connected resistors fails.

25. The apparatus of claim 24 wherein the entity is a human user of the apparatus and said apparatus dissipates electrostatic charges from the human user to the grounding surface.

26. The apparatus of claim 24 wherein the entity is an electrical device and wherein said apparatus dissipates electrostatic charges from the electrical device to the grounding surface.

27. The apparatus of claim 25 wherein said electrically conductive layers and said at least one set of parallel-connected resistors are located within the sole of footwear.

* * * * *